US007086936B1

(12) United States Patent
Kiermasz

(10) Patent No.: US 7,086,936 B1
(45) Date of Patent: Aug. 8, 2006

(54) LINEAR CHEMICAL MECHANICAL PLANARIZATION (CMP) SYSTEM AND METHOD FOR PLANARIZING A WAFER IN A SINGLE CMP MODULE

(75) Inventor: Adrian Kiermasz, Union City, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/743,923

(22) Filed: Dec. 22, 2003

(51) Int. Cl.
*B24B 9/00* (2006.01)

(52) U.S. Cl. ..... 451/168; 451/296

(58) Field of Classification Search ..... 451/168, 451/296

See application file for complete search history.

(56) References Cited

U.S. PATENT DOCUMENTS 6,126,512 A * 10/2000 Chao et al. ..... 451/9
6,168,508 B1 * 1/2001 Nagahara et al. ..... 451/527
6,241,583 B1 * 6/2001 White ..... 451/41
6,261,168 B1 * 7/2001 Jensen et al. ..... 451/527
6,315,857 B1 * 11/2001 Cheng et al. ..... 156/345.12
6,461,226 B1 * 10/2002 Yi ..... 451/41
6,572,439 B1 6/2003 Drill et al. ..... 451/5
2002/0197946 A1 * 12/2002 Emami et al. ..... 451/527
2003/0106807 A1 * 6/2003 Basol et al. ..... 205/670

OTHER PUBLICATIONS

Rodel(R) Finishing Pads, Feb. 1, 2002.*
Encyclopedia.com definition of synthetic rubber, Apr. 19, 2003 (see appended site update page).*

* cited by examiner

*Primary Examiner*—M. Rachuba
(74) *Attorney, Agent, or Firm*—Martine Penilla & Gencarella LLP

(57) ABSTRACT

A linear chemical mechanical planarization (CMP) belt pad includes a first portion comprised of a first pad material, e.g., polyurethane, and a second portion comprised of a second pad material, e.g., porous rubber. The first portion has a first end and a second end. The second portion is situated between the first and second ends of the first portion and extends substantially across a width of the belt pad. Alternatively, the second portion may be embedded in the first portion such that a peripheral surface of the second portion is surrounded by a surface of the first portion. A linear CMP system and a method for planarizing a wafer in a single linear CMP module also are described.

5 Claims, 4 Drawing Sheets

LINEAR CHEMICAL MECHANICAL PLANARIZATION (CMP) SYSTEM AND METHOD FOR PLANARIZING A WAFER IN A SINGLE CMP MODULE

BACKGROUND OF THE INVENTION

The present invention relates generally to semiconductor fabrication and, more particularly, a linear chemical mechanical planarization (CMP) system and method for planarizing a wafer.

In the fabrication of semiconductor devices, CMP is used to planarize globally the surface of an entire semiconductor wafer. CMP has three key parameters that need to be optimized, namely (1) defects, (2) dishing, and (3) throughput. During the fabrication of semiconductor devices, a number of CMP operations are typically carried out (e.g., bulk copper removal, barrier removal, buffing, over polish, etc.), and each CMP operation has a unique process condition. To optimize each of the three key CMP parameters, a single CMP system typically includes several CMP modules with each module uniquely optimized for each CMP operation.

FIG. 1 is a simplified schematic diagram of a conventional CMP system 100 that includes three linear CMP modules. As shown in FIG. 1, CMP system 100 includes a first linear CMP module (LPM1) 102, a second linear CMP module (LPM2) 104, and a third linear CMP module (LPM3) 106. In one configuration, LPM1 102 and LPM2 104 have polyurethane belt pads configured for bulk copper removal. On the other hand, LPM3 106 has a Politex belt pad configured for barrier removal and buffing. Although defects and throughput are optimized in this configuration, topography is compromised. In another configuration, LPM1 102, LPM2 104, and LPM3 106 all have polyurethane belt pads configured for bulk copper removal, barrier removal, and buffing, respectively. Although topography and throughput are optimized in this configuration, defects are compromised. In still another configuration, LPM1 102 and LPM2 104 have polyurethane belt pads configured for bulk copper removal and barrier removal, respectively. LPM3 106 has a Politex belt pad configured for buffing. Although topography and defects are optimized in this configuration, throughput is compromised.

In view of the foregoing, there is a need for a linear CMP system that can optimize all three key CMP parameters.

SUMMARY OF THE INVENTION

Broadly speaking, the present invention fills this need by providing a linear chemical mechanical planarization (CMP) belt pad, system, and method for planarizing a wafer in a single CMP module.

In accordance with a first aspect of the present invention, a linear CMP belt pad is provided. The linear CMP belt pad includes a first portion comprised of a first pad material and a second portion comprised of a second pad material. The first portion has a first end and a second end. The second portion is situated between the first and second ends of the first portion and extends substantially across a width of the belt pad.

In one embodiment, the first portion of the belt pad is configured for barrier removal. In one embodiment, the first pad material is comprised of polyurethane. In one embodiment, the second portion of the belt pad is configured for buffing. In one embodiment, the second pad material is comprised of porous rubber.

In an alternative embodiment, the second portion of the belt pad is embedded in the first portion. In particular, the second portion is embedded in the first portion such that a peripheral surface of the second portion is surrounded by a surface of the first portion.

In accordance with a second aspect of the present invention, a method for planarizing a wafer in a single CMP module is provided. In this method, a first planarization operation is conducted in the single linear CMP module by contacting a surface of the wafer with a surface of a rotating belt pad. Next, a rotation of the belt pad is stopped and a second planarization operation is conducted in the single linear CMP module by contacting the surface of the wafer with the surface of the belt pad.

In one embodiment, the second planarization operation is conducted by contacting the wafer with the second portion of the belt pad comprised of a second pad material. In one embodiment, relative motion between the surface of the wafer and the surface of the belt pad is created in the second planarization operation. In one embodiment, the relative motion is created by moving the wafer in a back and forth motion. In one embodiment, the relative motion is created by moving the belt pad in a back and forth motion.

In one embodiment, the first planarization operation is configured for barrier removal. In one embodiment, the second planarization operation is configured for buffing.

In accordance with a third aspect of the present invention, a linear CMP system is provided. The system includes a pair of rollers and a belt pad disposed on the rollers. The belt pad has a first portion comprised of a first pad material and a second portion comprised of a second pad material. The system also includes a wafer carrier disposed above a surface of the belt pad and a control system for controlling a rotation of the rollers. The control system is configured to stop rotation of the rollers such that the second portion of the belt pad is aligned under the wafer carrier.

In one embodiment, the belt pad has a reference notch and the control system is configured to determine a location of the second portion relative to the wafer carrier by using the reference notch.

It is to be understood that the foregoing general description and the following detailed description are exemplary and explanatory only, and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE EXEMPLARY EMBODIMENTS

Several exemplary embodiments of the invention will now be described in detail with reference to the accompanying drawings.

Figure 1:
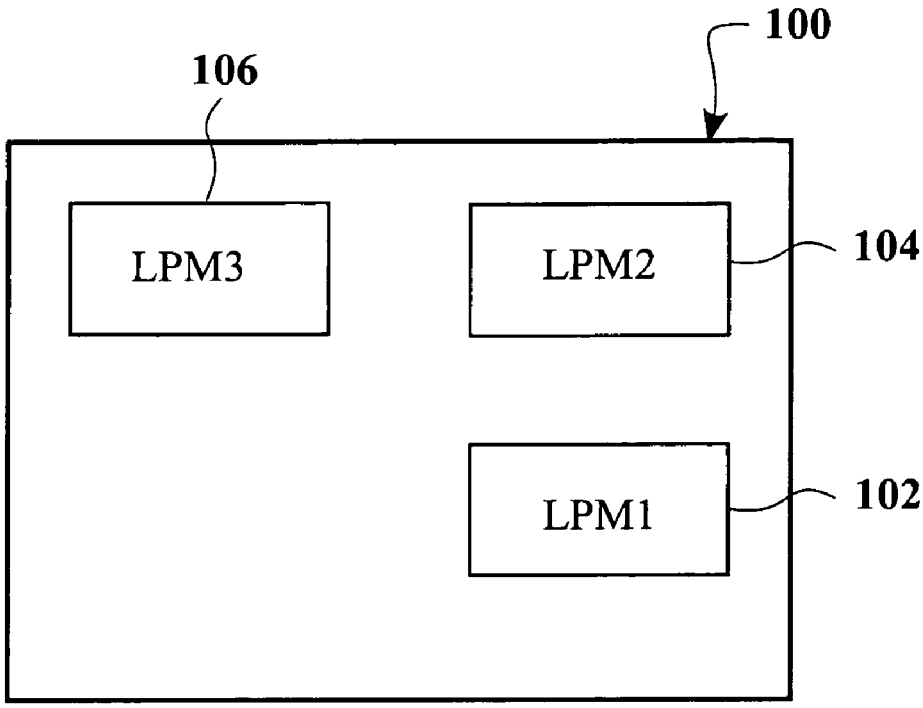
FIG. 1 (Prior Art)
FIG. 1 is a simplified schematic diagram of a conventional CMP system that includes three linear CMP modules.
Figure 2A:
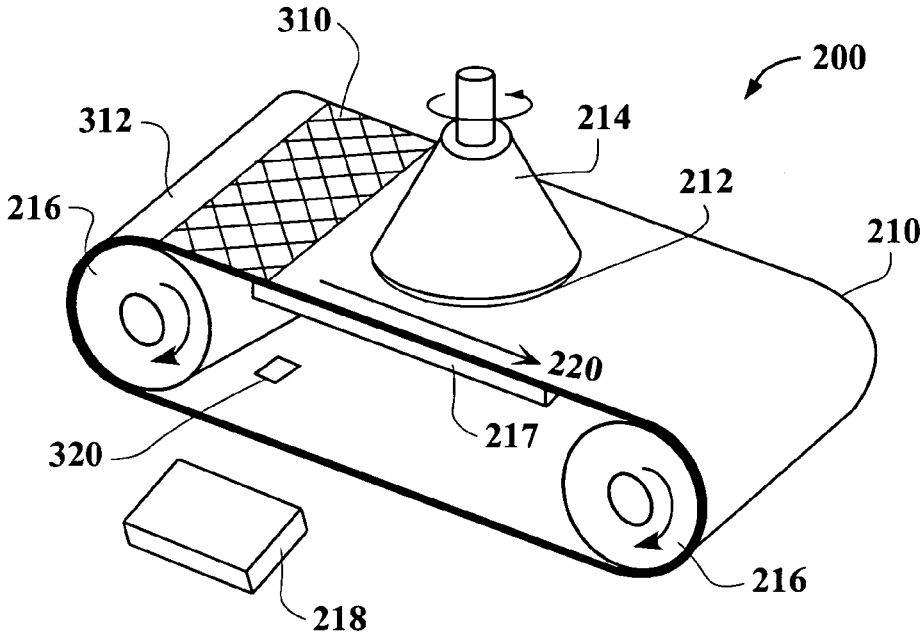
FIG. 2A is a simplified perspective view of linear CMP module, in accordance with one embodiment of the present invention.

FIG. 2A is a simplified perspective view of linear CMP module 200, in accordance with one embodiment of the present invention. As shown in FIG. 2A, linear CMP module 200 includes a belt pad 210 disposed on rollers 216. As is known to those skilled in the art, wafer carrier 214 supports wafer 212 and applies downward pressure on the wafer. Platen 217 is disposed below wafer carrier 214 and belt pad 210 to counteract the downward pressure by the wafer carrier. Linear CMP module 200 additionally includes control system 218 for controlling the rotation of rollers 216.

The linear CMP module 200 shown in FIG. 2A is conducting a first planarization operation. The first planarization operation is conducted by contacting a surface of wafer 212 with a surface of rotating belt pad 210 moving in a direction indicated by arrow 220. Belt pad 210 has a first portion 312 and a second portion 310. First portion 312 is comprised of a first pad material and second portion 310 is comprised of a second pad material. The pad materials can be any material suitable for planarization. For example, suitable pad materials include polyurethane (e.g. Rodel IC1000™) and porous rubber (e.g., Politex). To planarize the surface of wafer 212 uniformly, wafer carrier 214 also rotates the wafer during rotation of belt pad 210.

Since belt pad 210 has a first portion 312 and a second portion 310, the surface of wafer 212 contacts both the first portion and the second portion of the rotating belt pad in the first planarization operation. As a result, the planarization effect is essentially the average contact time of the surface of wafer 212 with each of first portion 312 and second portion 310 of belt pad 210. For example, if a length of first portion 312 is considerably longer than a length of second portion 310, then the surface of wafer 212 makes contact with the first portion considerably longer than the second portion as belt pad 210 rotates. As a result, first portion 312 dominates over second portion 312 and the overall planarization effect is similar to the effect with surface of wafer 212 making contact with the first portion only.

Figure 2B:
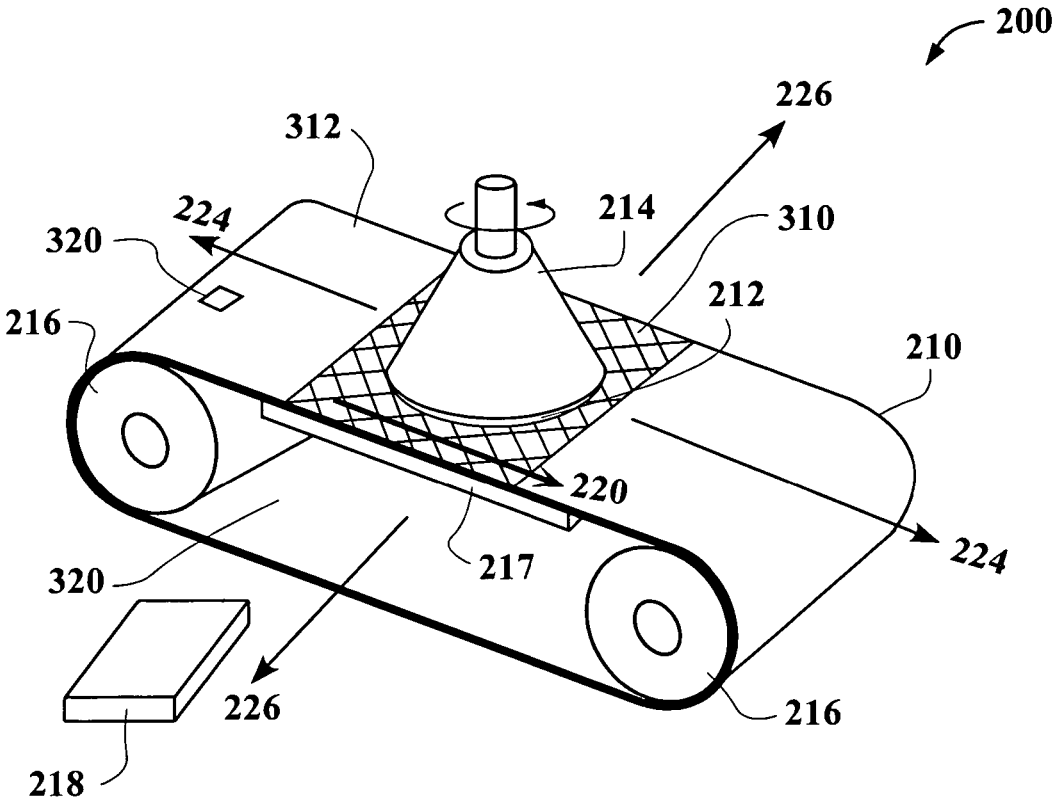
FIG. 2B is a simplified perspective view of linear CMP module shown in FIG. 2A conducting a second planarization operation, in accordance with one embodiment of the present invention.

FIG. 2B is a simplified perspective view of linear CMP module 200 shown in FIG. 2A conducting a second planarization operation, in accordance with one embodiment of the present invention. As shown in FIG. 2B, the rotation of belt pad 210 is stopped in the second planarization operation. In one embodiment, while the surface of wafer 212 is in contact with the surface of belt pad 210, control system 218 stops rotation of rollers 216 such that second portion 310 of the belt pad is aligned under wafer carrier 214. In another embodiment, wafer carrier 214 first lifts wafer 212 away from the surface of rotating belt pad 210 such that the surface of the wafer is not in contact with the belt pad. Subsequently, control system 218 stops rotation of rollers 216 such that second portion 310 of belt pad 210 is aligned under wafer carrier 214. Wafer carrier 214 then lowers wafer 212 onto the surface of stopped belt pad 210 such that the surface of the wafer contacts second portion 310 of the belt pad.

To stop rotation of rollers 216 such that second portion 310 of belt pad 210 is aligned under wafer carrier 214, control system 218 tracks the location of the second portion relative to the wafer carrier. Control system 218 may track the location of second portion 310 by various detection or indexing methods. For example, in one embodiment, control system 218 uses reference notch 320 in belt pad 210 to determine the location of second portion 310. Here, control system 218 essentially detects notch 320 during rotation of belt pad 210 and determines the location of second portion 310 by calculating the location of the notch relative to the second portion. Methods to detect notch 320 are well known to those skilled in the art. As a result, control system 218 can stop the rotation of rollers 216 such that second portion 310 of belt pad 210 is aligned under wafer carrier 214 to conduct the second planarization operation.

Once the surface of wafer 212 is in contact with second portion 310 of belt pad 210, relative motion between the surfaces of the wafer and the second portion is created to planarize the wafer. In one embodiment, relative motion is created by moving wafer carrier 214 in a back and forth motion. In another embodiment, belt pad 210 moves in a back and forth motion. The back and forth motion can be along a length of belt pad 210 in directions indicated by arrows 224 or along a width of the belt pad in directions indicated by arrows 226.

In short, FIG. 2A shows linear CMP module 200 conducting a first planarization operation by contacting a surface of wafer 212 with a surface of rotating belt pad 210. To conduct a second planarization operation, as shown in FIG. 2B, the rotation of belt pad 210 is stopped and the surface of wafer 212 again makes contact with the surface of the belt pad.

Figure 3A:
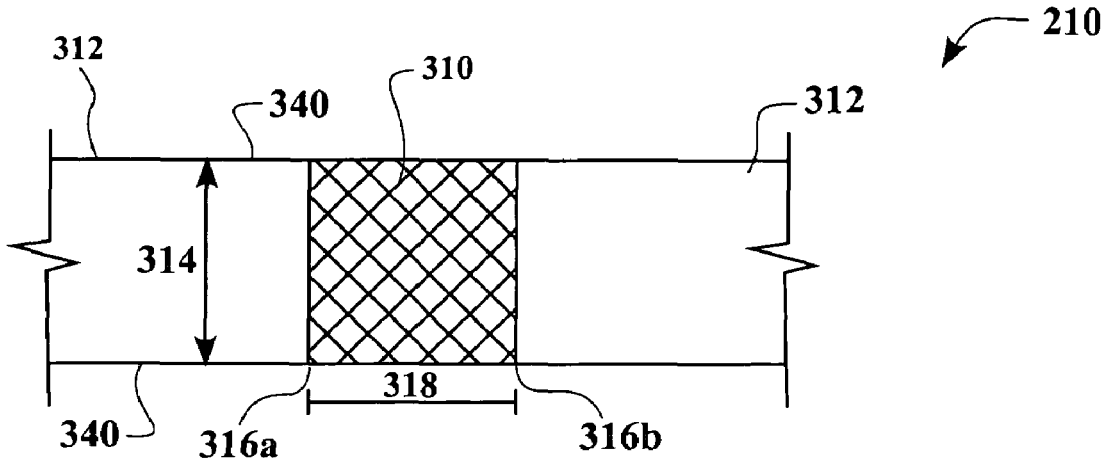
FIG. 3A is a detailed top view of a portion of belt pad shown in FIGS. 2A and 2B, in accordance with one embodiment of the present invention.
Figure 3B:
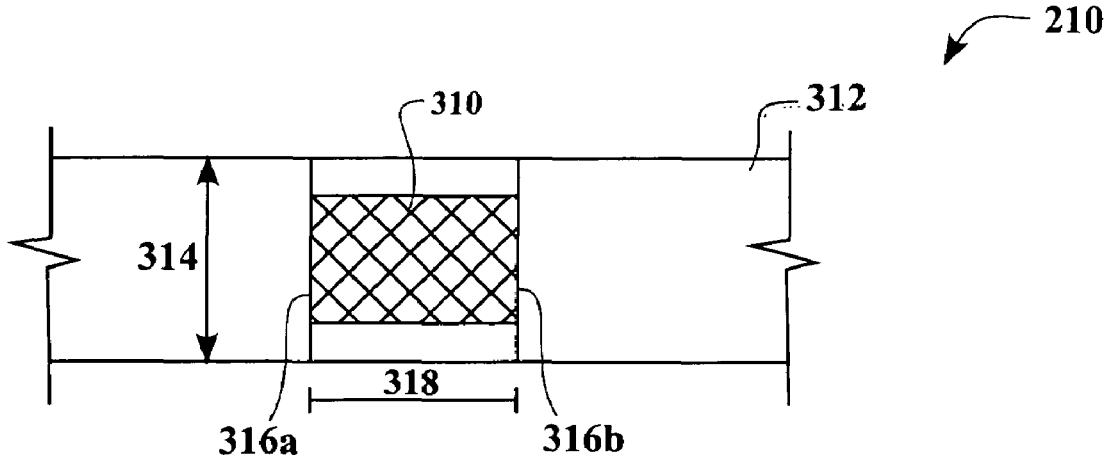
FIG. 3B is a detailed top view of a portion of belt pad with second portion extending substantially across a width of the belt pad, in accordance with one embodiment of the present invention.

FIG. 3A is a detailed top view of a portion of belt pad 210 shown in FIGS. 2A and 2B. First portion 312 of belt pad 210 has a first end 316*a* and a second end 316*b*, and second portion 310 is situated between the first end and the second end. In one embodiment, as shown in FIG. 3A, second portion 310 extends across the complete width 314 of belt pad 210 such that the edges of the second portion are flush against the edges 340 of the belt pad. In another embodiment, as shown in FIG. 3B, second portion 310 extends substantially across the width 314 of belt pad 210. As used herein, the term "substantially" means that second portion 310 extends from about 80% to 100% across the width 314 of belt pad 210.

Figure 3C:
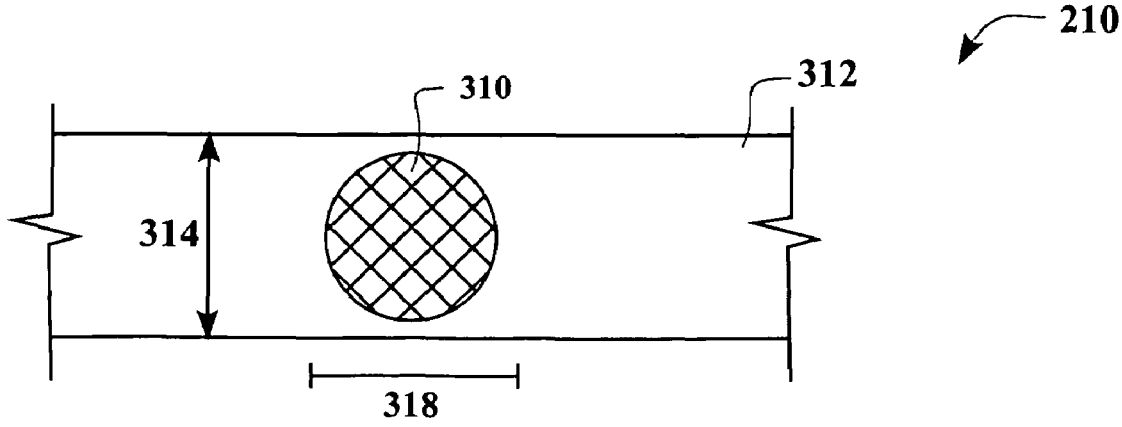
FIG. 3C is a detailed top view of a portion of belt pad with a circular second portion, in accordance with another embodiment of the present invention.

FIG. 3C is a detailed top view of a portion of belt pad 210, in accordance with another embodiment of the present invention. As shown in FIG. 3C, second portion 310 is embedded in first portion 312 of belt pad 210. The shape of second portion 310 can be in any suitable shape (e.g., rectangle, square, circle, star, oval, triangle, etc.). For example, in one embodiment, FIGS. 3A and 3B show rectangular second portions 310. In another embodiment, FIG. 3C shows a circular second portion 310.

The length 318 of second portion 310 can be any suitable length. For example, second portion 310 can to be somewhat larger than wafer 212 such that there is enough space for the wafer to move in a back and forth motion relative to belt pad 210. By way of example, the length of second portion 310 is about 18 inches for a module configured for barrier removal as the first planarization operation and configured for buffing as the second planarization operation. Alternatively, second portion 310 can be smaller than wafer 212. By way of example, a length of second portion 310 is half the diameter of wafer 212. Although wafer 212 is partially in contact with second portion 310 when the wafer carrier or belt pad is moving in a back and forth motion, the average contact time with the second portion is longer than the average contact time with first portion 312. As a result, second portion 310 dominates over first portion 312 and the overall planarization effect is similar to the effect with surface of wafer 212 making contact with the second portion only.

The second portion 310 may be embedded into first portion 312 by various techniques. For example, in one embodiment, second portion 310 may be embedded in first portion 312 of belt pad 210 by gluing the second portion onto a surface of the first portion. In another embodiment, a cutout in the shape of second portion 310 is made in first portion 312. Second portion 310 is then embedded in the cutout of first portion 312 such that a peripheral surface of the second portion is surrounded by the surface of the first portion. First portion 312 and second portion 310 are then stitched or glued together to form a sold belt pad 210. In still another embodiment, belt pad 210 with first portion 312 is cut to form a strip with first end 316*a* and second end 316*b*. Second portion 310 is then stitched or glued between first end 316*a* and second end 316*b* to form a continuous belt pad 210.

As discussed above, CMP has three key parameters that need to be optimized, namely (1) defects, (2) dishing, and (3) throughput. The present invention can be used in conjunction with other linear CMP modules to optimize all three key CMP parameters. An exemplary embodiment includes a CMP system that includes three linear CMP modules: a first linear CMP module (LPM1), a second linear CMP module (LPM2), and a third linear CMP module (LPM3). LPM1 has a polyurethane belt pad configured for bulk copper removal. LPM2 has a polyurethane belt pad configured for over polish. LPM3 has a belt pad with a first portion and a second portion and is configured for two planarization operations. The first portion is comprised of a polyurethane pad material and the second portion is comprised of a porous rubber pad material.

In LPM3, the first operation is configured for barrier removal and is conducted by contacting a surface of the wafer with a surface of the rotating belt pad. By way of example, belt pad rotates at about 300 feet per minute during barrier removal. As used herein, the term "about" means that the specified dimension or parameter may be varied within an acceptable manufacturing tolerance for a given application. In one embodiment, the acceptable manufacturing tolerance is +10%. To planarize the surface of wafer uniformly, wafer carrier also rotates during rotation of belt pad. By way of example, wafer carrier rotates in the range from about 10 rotations per minute (rpm) to about 20 rpm during barrier removal.

The second operation is configured for buffing. In the second operation, the rotation of the belt pad is stopped. Thereafter, the surface of the wafer makes contact with the second portion of the belt pad. Relative motion is created by either moving the wafer carrier or the belt pad in a back and forth motion. Additionally, to planarize the surface of wafer uniformly, wafer carrier also rotates. By way of example, wafer carrier rotates in the range from about 20 rpm to about 100 rpm during buffing. As a result, a single linear CMP module being able to conduct more than one planarization operation can be used to optimize all three key CMP parameters when used in conjunction with other linear CMP modules in a linear CMP system.

In summary, the present invention provides a linear CMP system and a method for planarizing a wafer in which two planarization operations are conducted in a single linear CMP module. Other embodiments of the invention will be apparent to those skilled in the art from consideration of the specification and practice of the invention. The embodiments and preferred features described above should be considered exemplary, with the invention being defined by the appended claims and equivalents thereof.

What is claimed is:

1. A linear chemical mechanical planarization (CMP) system, comprising:

a pair of rollers;

a belt pad disposed on the rollers, the belt pad having a first portion comprised of a first pad material and a second portion comprised of a second pad material, and the belt pad having a reference notch;

a wafer carrier disposed above a surface of the belt pad; and a control system for controlling a rotation of the rollers, the control system being configured to determine a location of the second portion of the belt pad relative to the wafer carrier by using the reference notch, and the control system being configured to stop rotation of the rollers such that the second portion of the belt pad is aligned under the wafer carrier.

2. The CMP system of claim 1, wherein the first portion of the belt pad is configured for barrier removal.

3. The CMP system of claim 1, wherein the first pad material is comprised of polyurethane.

4. The CMP system of claim 1, wherein the second portion of the belt pad is configured for buffing.

5. The CMP system of claim 1, wherein the second pad material is comprised of porous rubber.

* * * * *